US008122897B2

(12) United States Patent
Mitsuhashi

(10) Patent No.: US 8,122,897 B2
(45) Date of Patent: Feb. 28, 2012

(54) RESIN PELLET STORAGE APPARATUS AND METHOD OF CLEANING THE SAME

(75) Inventor: Kenichi Mitsuhashi, Ichihara (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 355 days.

(21) Appl. No.: 12/097,885

(22) PCT Filed: Dec. 13, 2006

(86) PCT No.: PCT/JP2006/324792

§ 371 (c)(1),
(2), (4) Date: Jun. 18, 2008

(87) PCT Pub. No.: WO2007/072715

PCT Pub. Date: Jun. 28, 2007

(65) Prior Publication Data

US 2009/0263201 A1 Oct. 22, 2009

(30) Foreign Application Priority Data

Dec. 21, 2005 (JP) ..... 2005-368734

(51) Int. Cl.
*B07C 5/36* (2006.01)

(52) U.S. Cl. ..... 134/104.2; 209/244; 209/606; 209/638

(58) Field of Classification Search ..... None
See application file for complete search history.

(56) References Cited

U.S. PATENT DOCUMENTS 4,896,590 A * 1/1990 Groos ..... 454/88
(Continued)

FOREIGN PATENT DOCUMENTS

JP 50-41661 11/1975
(Continued)

OTHER PUBLICATIONS

Machine Translation of JP 11-180490 by Chiyawandani et al., published Jul. 6, 1999.*

*Primary Examiner* — Michael Kornakov
*Assistant Examiner* — Ryan Coleman
(74) *Attorney, Agent, or Firm* — Oblon, Spivak, McClelland, Maier & Neustadt, L.L.P.

(57) ABSTRACT

There is here disclosed a resin pellet store device including a silo (1) in which resin pellets are stored; an discharge route for ON-SPEC products (2) through which resin pellets having a low content of foreign substances stored above the vicinity of the lowermost part in the silo (1) are discharged as ON-SPEC products from the silo (1); and another discharge route for OFF-SPEC products (3) through which resin pellets having a high content of foreign substances accumulated in the vicinity of the lowermost part in the silo (1) are discharged as OFF-SPEC products from the silo (1). In consequence, the resin pellets having a high content of foreign substances to be treated as the OFF-SPEC products are clearly sorted out in the silo and discharged therefrom to reduce the content of the foreign substances in the ON-SPEC products. Moreover, the OFF-SPEC products are discharged through another route to avoid the contamination of a downstream facility.

9 Claims, 8 Drawing Sheets

U.S. PATENT DOCUMENTS

| | | | |
|---|---|---|---|
| 5,494,171 | A | 2/1996 | Kazamoto et al. |
| 6,245,405 | B1 | 6/2001 | Kawano |

FOREIGN PATENT DOCUMENTS

| | | |
|---|---|---|
| JP | 2-83079 | 6/1990 |
| JP | 4-43007 | 2/1992 |
| JP | 5-23515 | 6/1993 |
| JP | 6-144484 | 5/1994 |
| JP | 6-270145 | 9/1994 |
| JP | 9-254190 | 9/1997 |
| JP | 10-113929 | 5/1998 |
| JP | 11-180490 | 7/1999 |
| JP | 11-342510 | 12/1999 |

* cited by examiner (a)

FIG.6 PRIOR ART
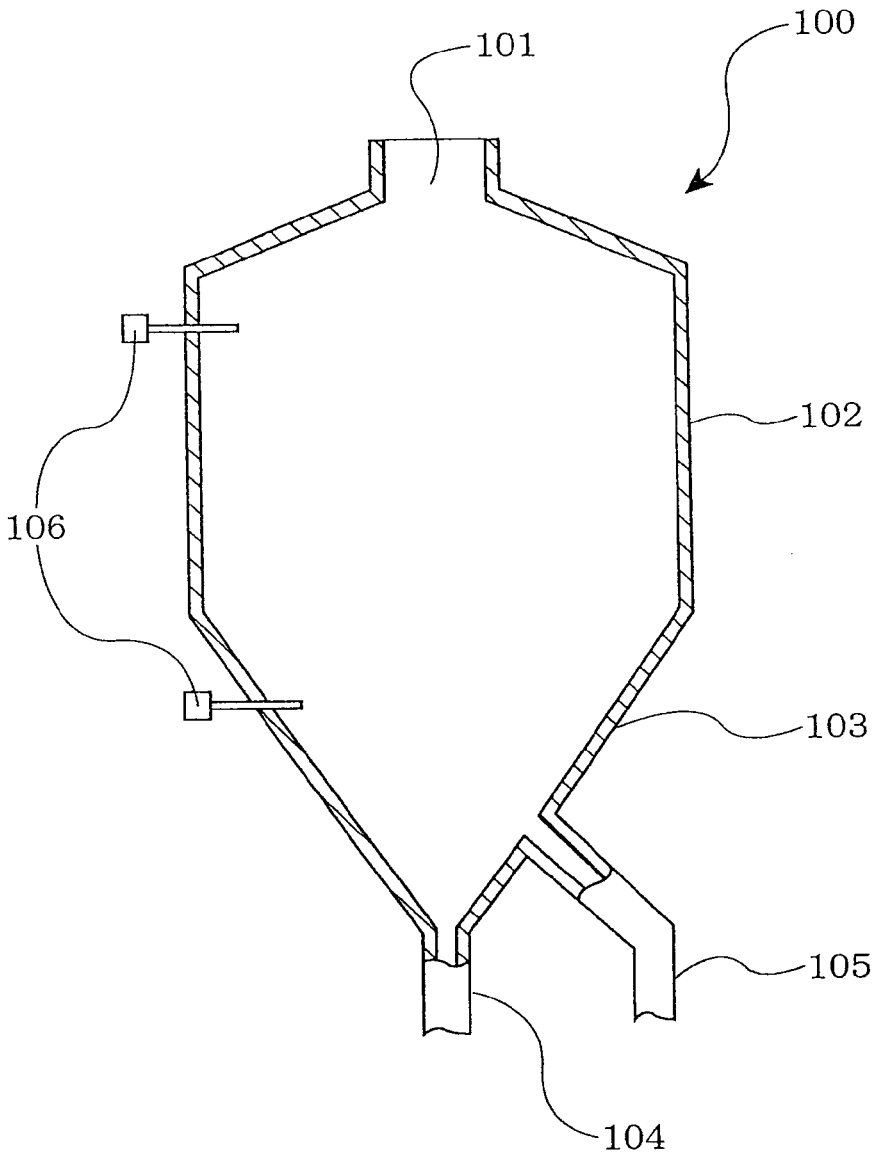

FIG.7 PRIOR ART
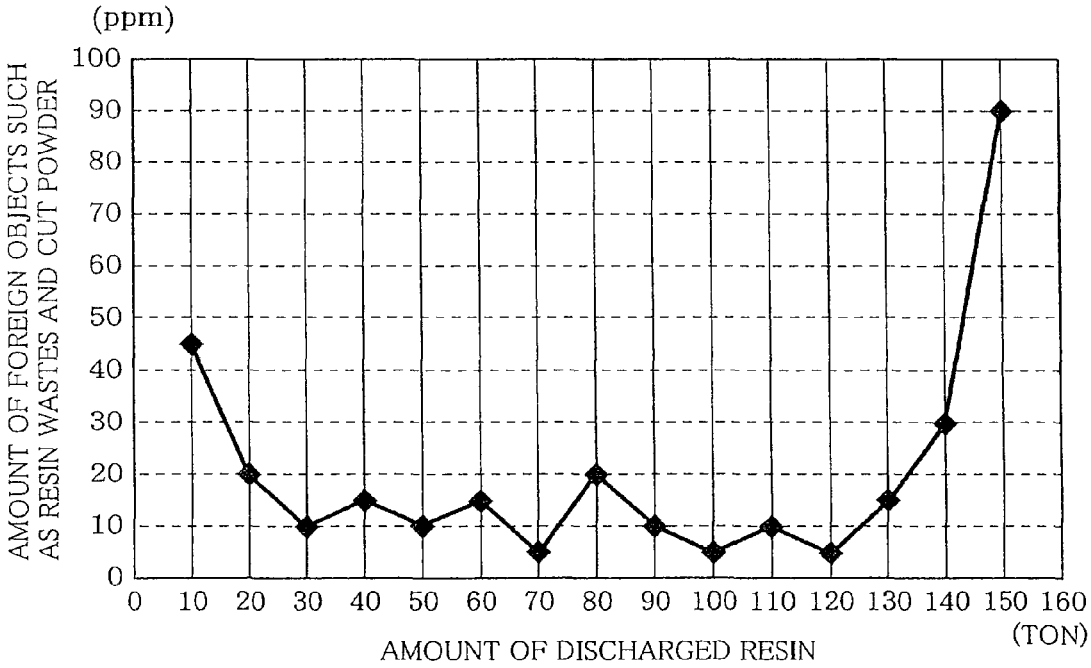

FIG.8 PRIOR ART
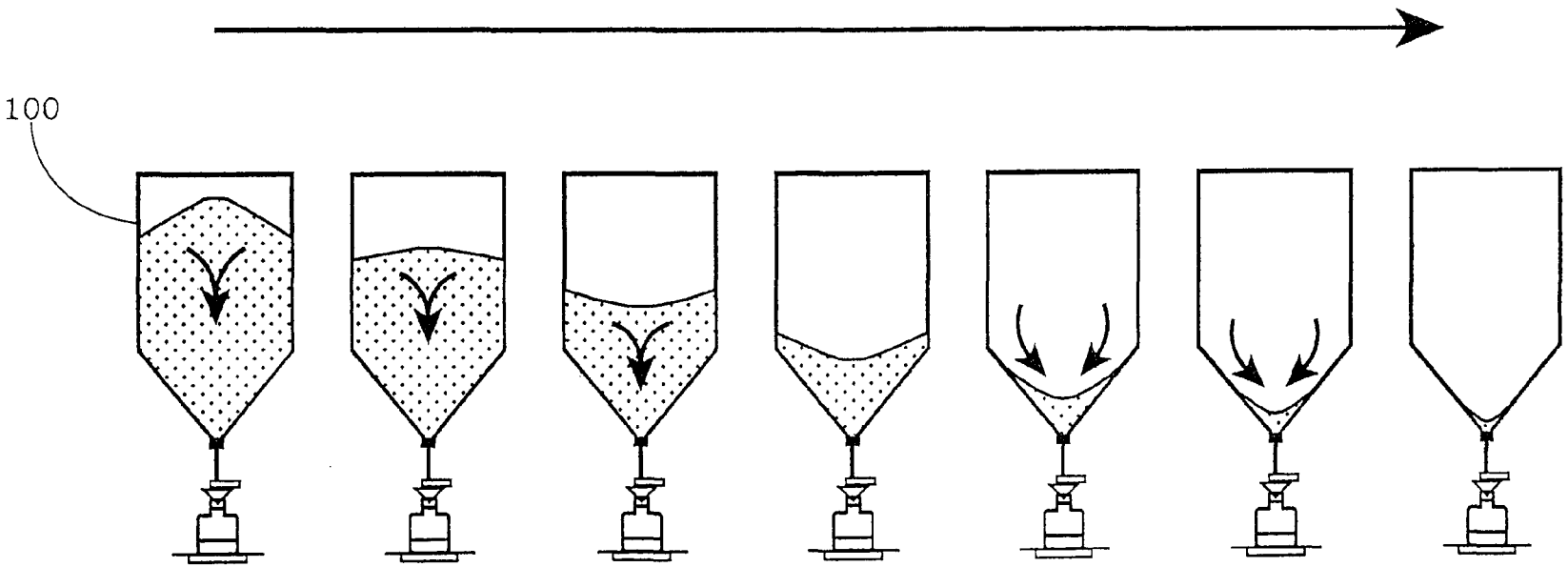

RESIN PELLET STORAGE APPARATUS AND METHOD OF CLEANING THE SAME

TECHNICAL FIELD

The present invention relates to a resin pellet store device including a silo in which resin pellets are stored, and a cleaning method thereof. More particularly, it relates to a resin pellet store device and a cleaning method thereof which are suitable for storage of polycarbonate-based resin pellets, cyclohexane-based resin pellets or the like requiring a low content of foreign substances.

BACKGROUND ART

Resin pellets requiring a low content of foreign substances have been known. For example, polycarbonate-based resin pellets with a low content of foreign substances or cyclohexane-based resin pellets with a low content of foreign substances used as a material for a substrate of an optical disk require reductions in the content of metallic particles derived from such a facility as a silo or pipe, the content of fine resin powder generated in the pelletizing processes; forming resin pellets through cutting resin strands extruded from an extruder, the content of small resin fragments generated through rubbed against inner wall of pipes, valves or silos when the pellet resins are pneumatically conveyed, etc. The reason is that, in an optical disk having an optical disk substrate formed of the resin pellets, the foreign substances inhibit the transmission of laser and increase errors when information recorded in the optical disk is read with the laser or when the information is written in the optical disk. Especially, in recent years, requirements for the reduction of contained foreign substances have been increasingly severe along with an increase in a storage capacity (recording density) in the optical disks. A removing device (see, e.g., Patent Document 1) which removes the foreign substances contained in the resin pellets, and a material for use in optical disk substrates which generates a small amount of resin fine powder (see, e.g., Patent Document 2) are also proposed.

Patent Document 1: Japanese Patent Application Laid-Open No. 6-270145; and

Patent Document 2: Japanese Patent Application Laid-Open No. 11-342510.

Along with an increase in the global demand for optical disk products, the amount of production of pellets with a low content of foreign substances which are typified by a polycarbonate-based resin or a cyclohexane-based resin for use in the optical disk substrate and so on, has been increasing, and its production facilities have been increasing in size. For example, the silo in which the resin pellets are stored has also been increasing in size. In such a silo, however, the first portion of resin pellets discharged from the silo and the last portion of resin pellets discharged from the silo has a higher content of foreign substances, as compared with the middle portion.

FIG. 6 is a schematic sectional view of a resin pellet store device according to a conventional example, FIG. 7 is a graph showing the content of the foreign substances in the resin pellets discharged from the resin pellet store device according to the conventional example, and FIG. 8 is an explanatory view showing in time series a behavior that the resin pellets are discharged from the resin pellet store device according to the conventional example.

As shown in FIG. 6, a general silo 100 for use as a resin pellet store device includes a filling inlet 101 through which the resin pellets are filled; a barrel part 102 in which the resin pellets are stored; a cone part 103 constituted by tapering a lower part of the silo 100 toward the center thereof; a discharge outlet 104 locating at the lowermost part of the silo 100 through which the resin pellets are discharged; a sampling outlet 105 through which the resin pellets stored above the lowermost part of the silo 100 are taken as a sample; and level meters 106.

FIG. 7 shows the change of the content of foreign substances measured while discharging the filled resin pellets from the silo 100 until the silo is emptied. The content of the foreign substances tends to increase in the first portion and last portion of resin pellets discharged from the silo 100.

This may be caused due to the influence of fine resin powder or small resin fragments sticking to the inner wall of the silo 100 by static electricity. For example, as shown in FIG. 8, the resin pellets in the silo 100 firstly fall down from the center thereof and are discharged therefrom as if sand fell in a so-called sand clock. Lastly, the outer peripheral pellets fall down and are discharged therefrom. Therefore, the last portion of resin pellets discharged tends to contain a large amount of fine resin powder or small resin fragment sticking to the inner wall of the silo 100. Especially, the last portion of resin pellets discharged fall down while rubbing against the inner wall of the cone part 103. In consequence, a large amount of foreign substances such as the metallic particles, the fine resin powder and the small resin fragments accumulated in the lowermost part may be contained in the last portion of pellets discharged from the silo 100.

In large-sized production facilities, there may be another packing facility such as a receptacle or container on the downstream side of the silo. In such a case, there may be a possibility that the downstream facility may be contaminated with the foreign substances contained in the last portion of resin pellets discharged from the silo. As a result, the first portion of resin pellets discharged from the silo at the next lot packing may also be contaminated.

Therefore, the last portion of resin pellets discharged should be separately treated as OFF-SPEC products through other routes.

The amount of the pellets to be treated as OFF-SPEC products is an amount which exceeds a specified batch quantity (a capacity of a transport receptacle such as a flexible container or a lorry) at a boundary between the lots, depending on the size of the silo, the specifications of the resin pellets, the definition of the lot and so on. These pellets are treated as the so-called YAMAKAKE (the last portion of resin pellets of which the quantity is less than the specified batch quantity), without being mixed with the pellets of another (next) lot.

However, it is actually difficult to sort out ON-SPEC products and OFF-SPEC products. Therefore, there is a possibility that the resin pellets to be treated as the OFF-SPEC products are mixed with the ON-SPEC products, which might increase the content of the foreign substances in ON-SPEC products. In the case where the last portion of resin pellets discharged are treated in a route different from that for the ON-SPEC products, it is necessary to switch the routes, leading to a problem of laborious facility management.

In order to prevent the last portion of resin pellets discharged from becoming OFF-SPEC products, a technique of homogenizing resin pellets in the silo by using a silo homogenizing device referred to as an after-blender may be used. However, the after-blender mixes the fine resin powder and the small resin fragments temporarily sticking to the inner wall of the silo by the static electricity with resin pellets again, which might increase the content of those foreign substances.

Therefore, for the resin pellets requiring a low content of foreign substances, which are used as the low material of optical disk substrates and so on, the after-blender can not be considered to be a suitable solution method.

In addition, Patent Document 1 discloses a removing device for removing fine resin powder from the resin pellets. This removing device is installed in resin pellet supply route between the silo in which the resin pellets are stored and a transport receptacle such as the lorry. Fine resin powder can be actively removed from the resin pellets by blowing an ionized air into the removing device. Then, removed fine resin powder is discharged together with air through the exhaust outlet. In Patent Document 1, however, there is not any detailed description concerning the silo.

Moreover, Patent Document 2 discloses a material for use in the optical disk substrate in which the generation of fine powder is reduced. In this material, the content of the resin fine powder having 1.0 mm or less of a diameter is set at 250 ppm or less, further preferably 150 ppm or less. However, in the case of the resin pellets having a low content of foreign substances, which will be used for DVDs such as DVD-Rs and DVD-RAMs, the above can not satisfy the requirements of disk manufacturers, unless the content of fine resin powder may be reduced down to less than 50 ppm, preferably to less than 30 ppm.

Furthermore, in Patent Document 2, pelletizing conditions of strands extruded from an extruder are described. Accordingly, Patent Document 2 does not include any specific description concerning the silo in which the resin pellets are stored.

The present invention has been developed in view of the above circumstances, and an object of the present invention is to provide a resin pellet store device and a cleaning method thereof in which the portion of pellets with a higher content of foreign substances to be treated as OFF-SPEC products are properly sorted out. Besides, the OFF-SPEC products are separately discharged through another route, in order to prevent ON-SPEC products having a low content of foreign substances from being contaminated in a downstream facility.

DISCLOSURE OF THE INVENTION

A resin pellets store device of the present invention for achieving the above object comprises a silo in which resin pellets are stored; one discharge route for ON-SPEC products; the resin pellets having a low content of foreign substances which are stored above the vicinity of the lowermost part in the silo, and another discharging route for OFF-SPEC products; the resin pellets having a high content of foreign substances which are stored in the vicinity of the lowermost part in the silo.

In this case, the resin pellets having a high content of foreign substances to be treated as OFF-SPEC products are properly sorted out in the silo, so that ON-SPEC products may not be contaminated with OFF-SPEC products.

Furthermore, since the discharge route for ON-SPEC products and the discharge route for OFF-SPEC products are separately provided, the risk that the downstream facility may be contaminated with OFF-SPEC products can be avoided, and the management of the facility can be also simplified.

Moreover, in the case of the resin pellet store device of this present invention, the discharge route for ON-SPEC products can have a multiple tube structure divided into a plurality of portions, for its pellet inside.

In this case, a blending function can be added to discharge route for ON-SPEC products, and the content of foreign substances contained in ON-SPEC products can be also uniformed.

Furthermore, the resin pellet store device of this present invention may include a guide member which is installed on the top part of the silo. As a result, resin pellets charged from the top of silo can fall down along an inner wall of the silo. In this case, when the pellet charging into the silo is started, the resin pellets fall down to hit the inner wall of the silo. As a result, the fine resin powder and small resin fragments sticking to the inner wall may also fall down together with the resin pellets. Therefore, these fine resin powder and small resin fragments can be accumulated in the vicinity of the lowermost part of the silo, and can be properly separated from ON-SPEC products. In consequence, it is possible to avoid the resin pellets from being additionally contaminated with fine resin powder and small resin fragments which have been still sticking to the inner wall of the silo since the last lot was packed.

Moreover, the resin pellet store device of this present invention may include a differential pressure adjusting ventilation route which equalizes the internal pressure of the silo with the external pressure of outside air, and in this differential pressure adjusting ventilation route, a filter, such as HEPA and ULPA, must be installed, so that the resin pellets stored in the silo may not be contaminated with the foreign substances from the outside air. In this case, even if the internal pressure of the silo becomes negative as the resin pellets are discharged, a differential pressure between the inside of silo and the outside is adjusted by clean air entering through the filter. Therefore, contamination in the silo due to the suction of the outside air can be prevented.

Moreover, the resin pellet store device of the present invention may include a gas supply or air supply route through which a gas or an air is supplied in order to keep the internal pressure of the silo positive, and in this gas or air supply route, a filter, such as HEPA and ULPA, must be installed, so that the resin pellets stored in the silo may not be contaminated with the foreign substances from the outside air. In this case, the internal pressure of the silo can be always kept positive by a clean gas or air, and hence the inside of the silo can be prevented from being contaminated due to the suction of the outside air.

Furthermore, the resin pellet store device of the present invention may include a sampling route through which the resin pellets stored above the lowermost part of the silo are taken as a sample.

In this case, it is possible to take a sample from the resin pellets having a lower content of foreign substances; which are equivalent to ON-SPEC products locating above the lowermost part of the silo.

In addition, a cleaning method of the resin pellet store device according to the present inventions is a method of cleaning a resin pellet store device comprising a silo in which resin pellets are stored; one discharge route for ON-SPEC products; the resin pellets having a low content of foreign substances which are stored above the vicinity of the lowermost part in the silo, and another route for OFF-SPEC products; the resin pellets having a high content of foreign substances which are stored in the lowermost part of the silo; and then removing substances sticking to an inner wall of the silo while the route for the OFF-SPEC product remains open.

In this case, fine resin powder and small resin fragments sticking to the inner wall of the silo can be removed and discharged through the discharge route for OFF-SPEC products. In consequence, it is possible to avoid an increase in the content of the foreign substances due to the mixing of the remaining fine resin powder and small resin fragments sticking to the inner wall of the silo since the last lot was packed.

Moreover, in the cleaning method of the resin pellet store device according to the present invention, the above removing step may be accomplished by blowing the inside of the silo with carrying air to introduce the resin pellets into the silo, and/or by applying mechanical impact or vibration to an outer wall of the silo.

In this case, when an existing facility is utilized or a comparatively simple device is added, the inside of the silo can be cleaned.

As described above, according to the present invention, the resin pellets having a high content of foreign substances, which should be treated as the OFF-SPEC products, are clearly sorted out in the silo. Therefore, the mixing of the resin pellets with a high content of foreign substances with the ON-SPEC products can be avoided to reduce the content of the foreign substances in the ON-SPEC products.

Moreover, since the discharge route for ON-SPEC products and the discharge route for OFF-SPEC products are separately provided, the contamination of a downstream facility with the OFF-SPEC products can be avoided.

BRIEF DESCRIPTION OF THE DRAWINGS

FIG. 6 is a schematic sectional view of a resin pellet store device according to a conventional example;

FIG. 7 is a graph showing contents of foreign substances in resin pellets discharged from the resin pellet store device according to the conventional example; and FIG. 8 is an explanatory view showing in time series a behavior that the resin pellets are discharged from the resin pellet store device according to the conventional example.

BEST MODE FOR CARRYING OUT THE INVENTION

An embodiment of the present invention will hereinafter be described with reference to the drawings.

[Resin Pellet Store Device]

First, a resin pellet store device according to the embodiment of the present invention will be described with reference to FIGS. 1 to 5.

Figure 1:
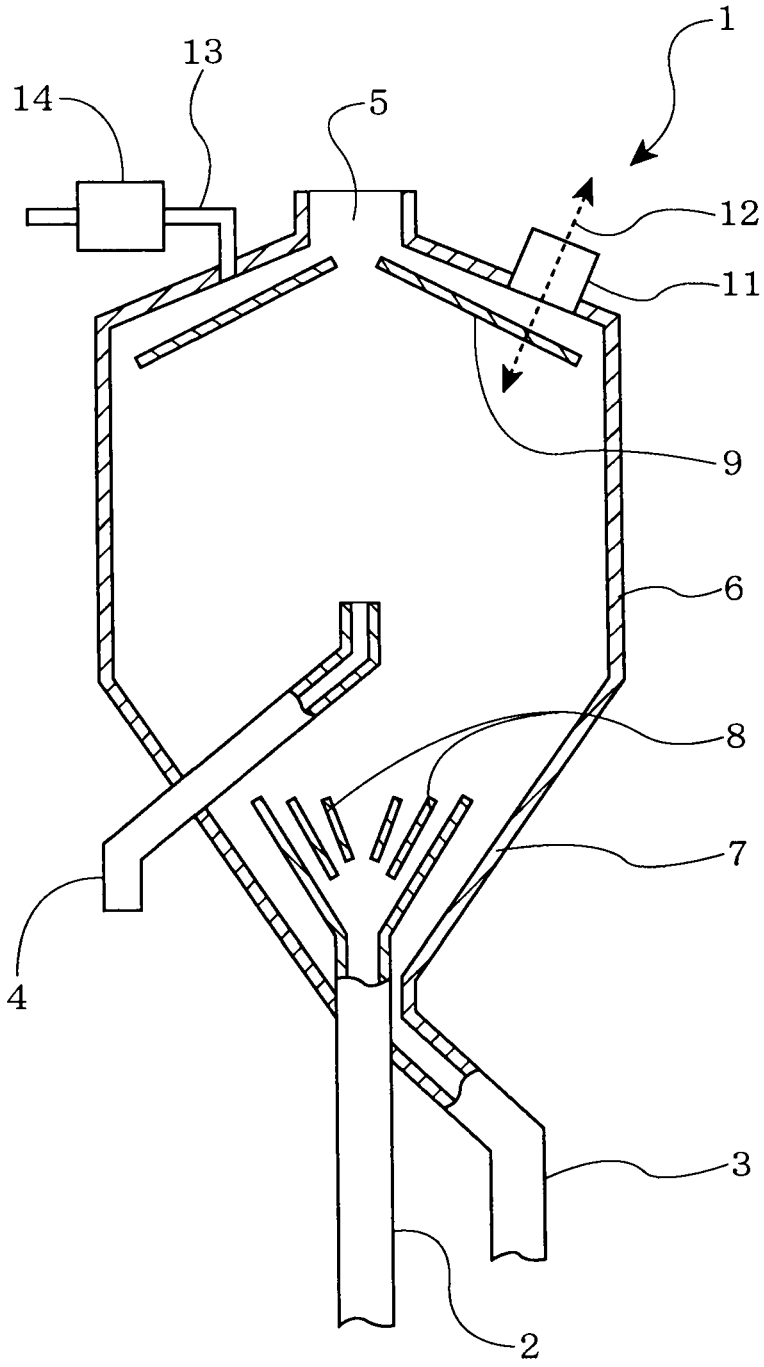
FIG. 1 is a sectional view of the whole front surface of a resin pellet store device according to an embodiment of the present invention.
Figure 2A:
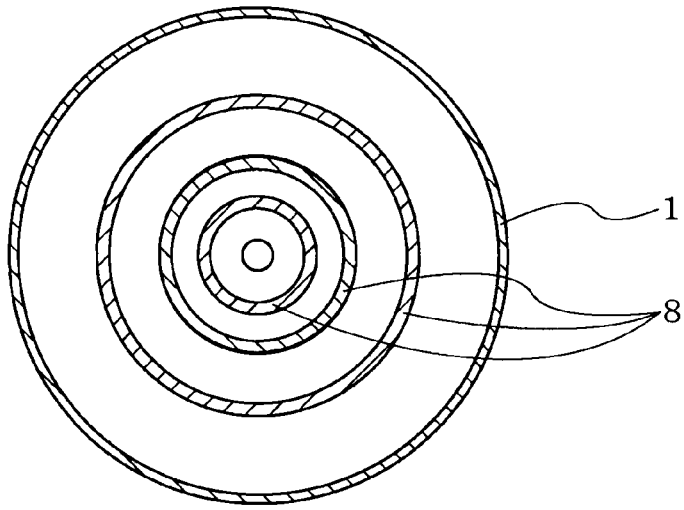
FIGS. 2(*a*), (*b*) are a sectional view of a flat surface of a lower part of the resin pellet store device according to the embodiment of the present invention, and a sectional view of a front surface of the lower part thereof, respectively.
Figure 2B:
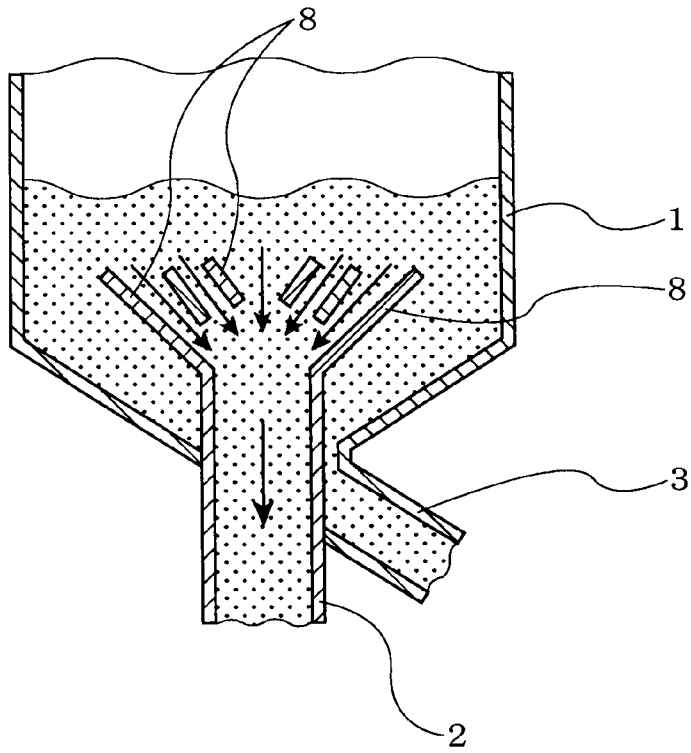
Figure 3A:
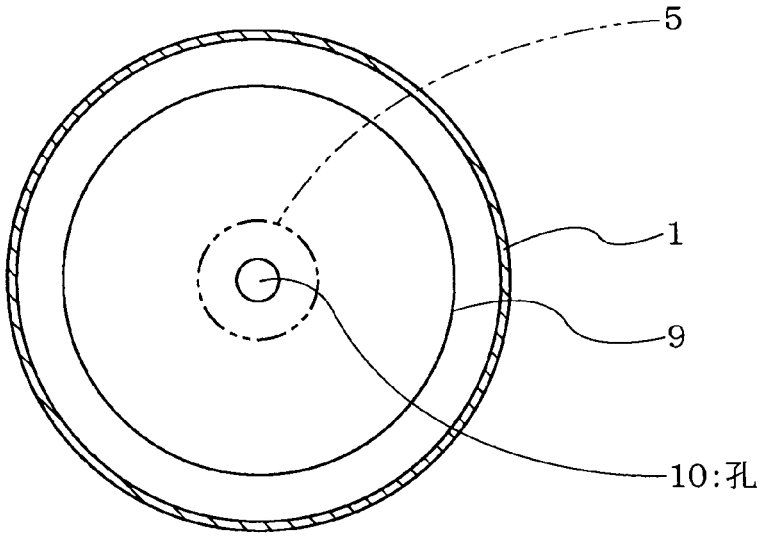
FIGS. 3(*a*), (*b*) are a sectional view of a flat surface of an upper part of the resin pellet store device according to the embodiment of the present invention, and a sectional view of a front surface of the upper part thereof, respectively.
Figure 3B:
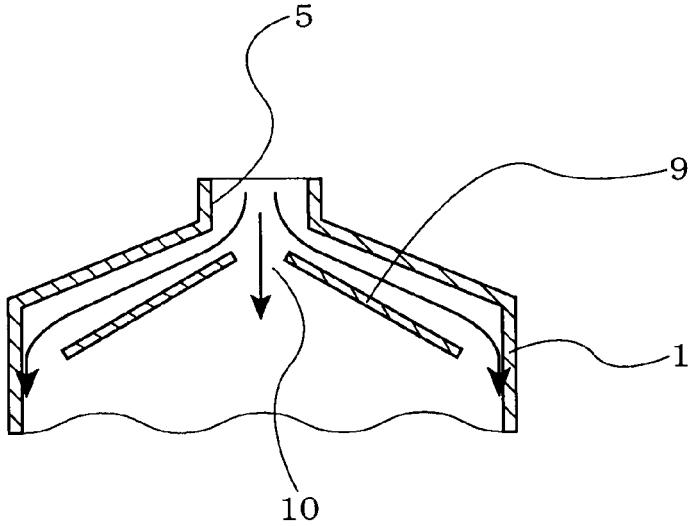
Figure 4A:
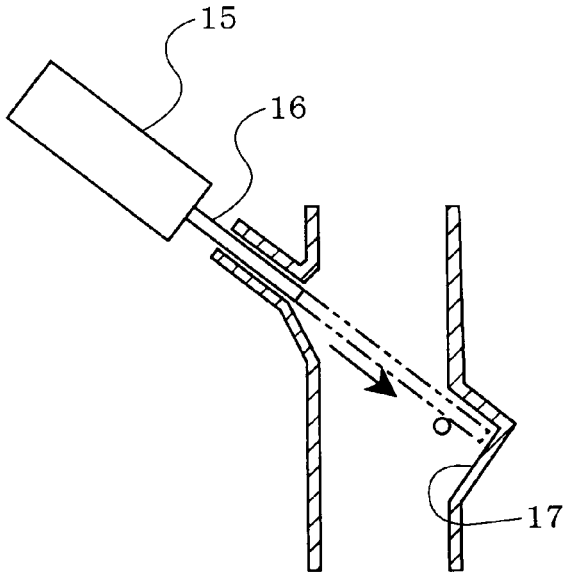
FIGS. 4(*a*), (*b*) are explanatory diagrams showing a slide gate valve of the resin pellet store device according to the embodiment of the present invention, respectively, and FIG. 4(*c*) is an explanatory diagram of a slide gate valve according to a conventional example.
Figure 4B:
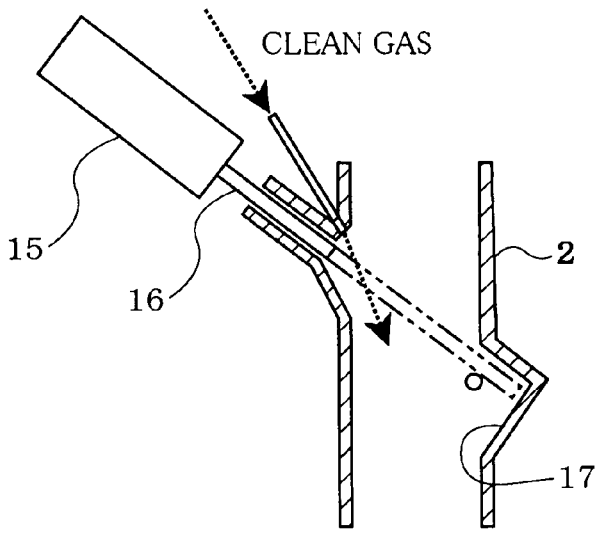
Figure 4C:
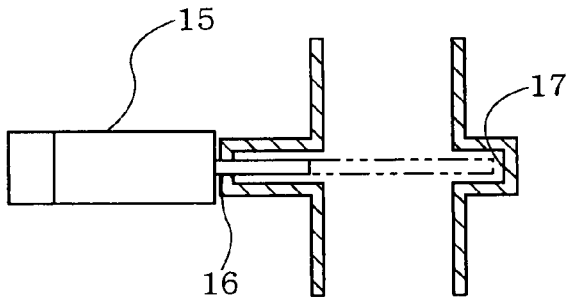

FIG. 1 is a sectional view of the whole front surface of the resin pellet store device according to the embodiment of the present invention; FIGS. 2(*a*), (*b*) are a sectional view of a flat surface of a lower part of the resin pellet store device according to the embodiment of the present invention, and a sectional view of a front surface of the lower part thereof, respectively; FIGS. 3(*a*), (*b*) are a sectional view of a flat surface of an upper part of the resin pellet store device according to the embodiment of the present invention, and a sectional view of a front surface of the upper part thereof, respectively; FIGS. 4(*a*), (*b*) are explanatory diagrams showing a slide gate valve of the resin pellet store device according to the embodiment of the present invention, respectively, and FIG. 4(*c*) is an explanatory diagram of a slide gate valve according to a conventional example; and FIGS. 5(*a*), (*b*) and (*c*) are a perspective view, a plan view and a side view showing a rotary valve of the resin pellet store device according to the embodiment of the present invention, respectively.

As shown in FIG. 1, the resin pellet store device includes a silo 1, a discharge route for ON-SPEC products 2, a discharge route for OFF-SPEC products 3, a sampling route 4 and the like.

The silo 1 includes a barrel part 6 having a filling inlet 5 in an upper part thereof; and a cone part 7 constituted by tapering a lower part of the silo 1 toward the center thereof, and the silo 1 stores resin pellets introduced through a filling inlet 5. The resin pellets include foreign substances such as fine resin powder and small resin fragments. A part of the foreign substances sticks to an inner wall of the silo 1 by static electricity, or falls down from this inner wall, and is easily accumulated in the lowermost part of the silo 1.

The discharge route for ON-SPEC products 2 is a route through which the resin pellets having a low content of foreign substances stored above the vicinity of the lowermost part in the silo 1 are discharged as ON-SPEC products from the silo 1. In the present embodiment, the route 2 is constituted of a pipe extending through a bottom part of the silo 1 in a vertical direction.

The discharge route for OFF-SPEC products 3 is a route through which the resin pellets having a high content of foreign substances stored in the vicinity of the lowermost part in the silo 1 are discharged as OFF-SPEC products from the silo 1. In the present embodiment, the route 3 is constituted of a pipe which communicates with the lowermost part of the cone part 7.

The sampling route 4 is a route through which the resin pellets having a low content of foreign substances stored above the vicinity of the lowermost part in the silo 1 are extracted as a sample from the silo 1. In the present embodiment, the route 4 is constituted of a pipe extending through the cone part 7 in an oblique direction.

As described above, the discharge route for ON-SPEC products 2 and the discharge route for OFF-SPEC products 3 are separately arranged in the resin pellet store device, and hence the resin pellets having a high content of foreign substances to be treated as the OFF-SPEC products are clearly sorted out in the silo 1. In consequence, the mixing of the resin pellets having a high content of foreign substances with the ON-SPEC products can be avoided to reduce the content of the foreign substances in the ON-SPEC products.

Moreover, since the discharge route 2 for ON-SPEC products and the discharge route 3 for OFF-SPEC products are separately provided, the risk that the downstream facility may be contaminated with the OFF-SPEC products can be avoided, and the management of the facility can also be simplified. In addition, the sampling route 4 is disposed above the vicinity of the lowermost part in the silo 1. Therefore, in the case where the resin pellets are taken, the resin pellets with the low content of foreign substances which are equivalent to the ON-SPEC products can be taken as the sample.

As shown in FIG. 2, for example, a resin pellet inflow port of the discharge route for ON-SPEC products 2 may be constituted as a multiple tube structure expanding upwards in a trumpet-like form. Specifically, a plurality of cone members 8 having different diameter dimensions may be combined to thereby form a plurality of concentric inflow ports as viewed from a plane.

In this case, the resin pellets which flow through the plurality of inflow ports are combined under the ports, whereby the resin pellets are blended. Therefore, a blender function is imparted to the discharge route for ON-SPEC products 2, and the content of the foreign substances in the ON-SPEC products can be uniformed.

It is to be noted that the resin pellet inflow port may be constituted as a spiral multiple structure. Even in this case, the above effect can be obtained.

As shown in FIGS. 1 and 3, it is preferable to dispose, in an upper part of the silo 1, a guide member 9 which allows the resin pellets charged from the top part of the silo 1 to fall down along the inner wall of the silo 1. For example, in a case where the guide member 9 is constituted of an umbrella-like member having a hole 10 in the center thereof, 80 to 90% of the charged resin pellets are allowed to fall down through the hole 10, and simultaneously 10 to 20% of the resin pellets which are mounted on an inclined surface of the guide member 9 are guided outwards and allowed to fall down along the inner wall of the silo 1.

In this case, when the pellet charging into the silo is started, the resin pellets hit the inner wall of the silo 1, and the fine resin powder and the small resin fragments sticking to this inner wall may fall down. Therefore, these fine resin powder and small resin fragments can be accumulated in the vicinity of the lowermost part of the silo 1, and can be properly separated from the ON-SPEC products. In consequence, it is possible to avoid the increase in the content of the foreign substances due to the remaining fine resin powder and small resin fragments sticking to the inner wall of the silo 1 since the last lot was packed.

As shown in FIG. 1, it is preferable to dispose, in the upper part of the silo 1, a differential pressure adjusting ventilation route 12 through which air is passed inwards and outwards via a filter 11 (an HEPA filter, preferably an ULPA filter).

In this case, even if the inside of the silo 1 becomes a negative pressure as the resin pellets are discharged, a differential pressure is adjusted by clean air entering through the filter 11. Therefore, it is possible to prevent contamination in the silo 1 due to the suction of the outside air.

As shown in FIG. 1, it is preferable to dispose, in the upper part of the silo 1, a gas supply route 13 through which a clean gas is supplied into the silo 1. For example, clean air or clean nitrogen entering through a filter 14 (the HEPA filter, preferably the ULPA filter) and dried at a dew point of −10° C. or less is supplied into the silo 1.

In this case, since the inside of the silo 1 can always be kept at a positive pressure by the clean gas, it is possible to prevent the contamination in the silo 1 due to the suction of the outside air.

In general, as a valve which opens/closes the discharging route 2 for ON-SPEC products, a ball valve, a butterfly valve, a slide gate valve and so on can be generally used. However, when such a valve is closed, it is difficult to prevent the resin pellets from being crushed through being caught between its moving parts and its body. As a result, the foreign substances once reduced will be generated again. Especially, in the case where a general slide-gate valve is used, as shown in FIG. 4(*c*), the resin pellets are inevitably crushed through being caught between the edge of the gate knife 16 and a gate pocket 17 into which the gate knife is stored. So, it has the high risk that foreign substances like fine resin powder and small resin fragments tend to generate readily, as compared with other types of valves.

To solve the problem, as shown in FIG. 4(*a*), the slide gate valve 15 of the present embodiment is formed so that the gate knife 16 is moved obliquely downwards from above and the obliquely lower gate pocket portion 17 has an open portion on a lower side thereof. In consequence, pellets crushed through being caught between the gate-knife and the gate-pockets can be reduced as little as possible.

When the gate knife 16 is obliquely stored back into the upper gate pocket, it is preferable to blow dried clean-air or dried clean-nitrogen gas, having at least a dew point −10° C., on the gate-knife, so that pellets sticking to the surface of the gate-knife due to static electricity will be blown off, whereby pellets sticking to the gate knife will not be crushed through being caught between the gate-knife and the gate pockets.

Furthermore, in the case where a transport receptacle is set on the downstream of the silo 1; especially, in the case where pellets are pneumatically conveyed, an ejector is often used. However, recent facilities have increased in size. In the case of a big facility in which more than 100 tons of pellets can be stored, a load due to the weight of the resin pellets is also too large. In such a case, it is sometimes difficult to get enough pneumatic conveyance performance by using valves and ejectors on the downstream of the silo 1. So, in a large-sized storage, a rotary valve is often used. However, in a case where a rotary valve is used, pellets will be crushed through being caught between its rotating blades and its body. As a result, foreign substances once reduced, such as fine resin powder or small resin fragments, will be generated again.

Figure 5B:
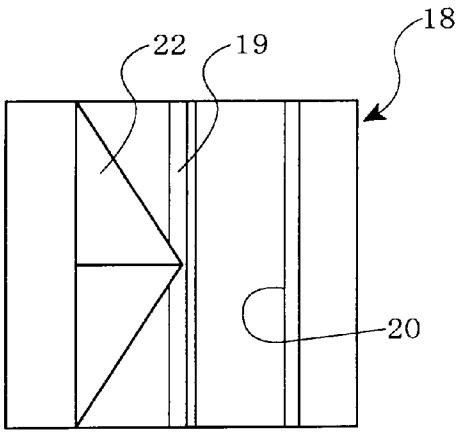
FIGS. 5(*a*), (*b*) and (*c*) are a perspective view, a plan view and a side view of a rotary valve showing the resin pellet store device according to the embodiment of the present invention, respectively.
Figure 5C:
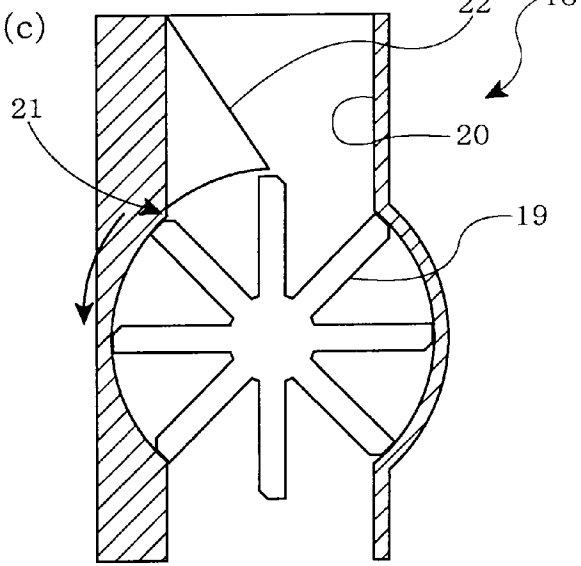
Figure 5A:
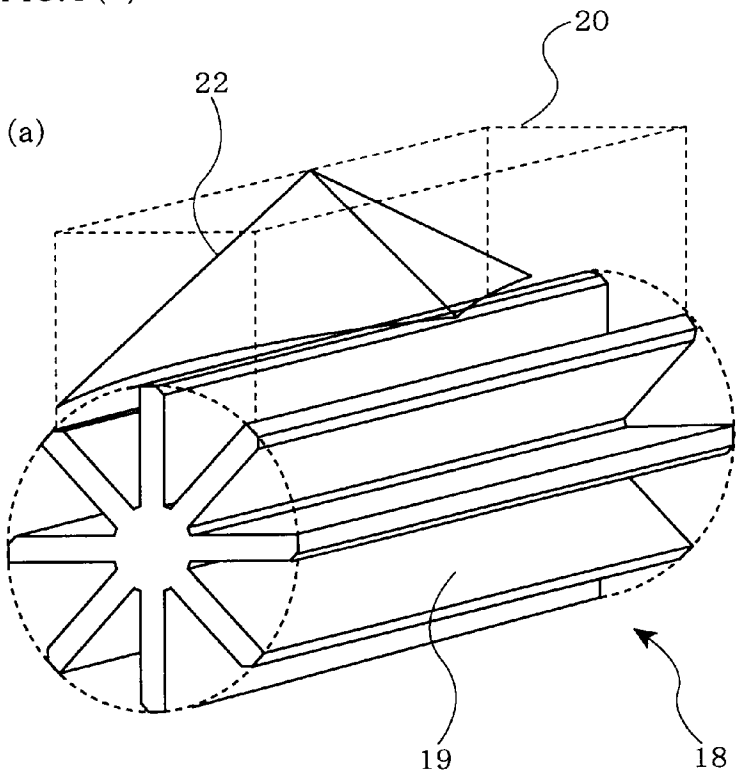

To solve the problem, in the rotary valve 18 of the present embodiment, as shown in FIG. 5, a guide section 22 is disposed above a position 21 where a rotor blades 19 and a housing 20 might nip the resin pellets on a resin pellet filling inlet side of the rotary valve 18, and hence the resin pellets are guided to the following rotor blades 19 by the guide section 22 to prevent the nip.

In this example, a housing side of the rotary valve 18 is contrived, but also by the rotor blades 19 formed into a "V"-shape, a similar effect can be expected.

It is to be noted that, within the silo 1, all weld beads on a pellet contact surface thereof have to be removed therefrom to obtain surface roughness (JIS G4305) corresponding to that of at least an IIb plate. It is preferable to buff the contact surface by use of an abrasive (JIS R6001) having a grain size of preferably #300, more preferably #400 or more.

Moreover, also within the slide gate valve or the rotary valve, all weld beads on a pellet contact surface thereof have to be removed therefrom, and then the contact surface have to be buffed by use of an abrasive having a grain size of at least #300, preferably #400 or more. [Cleaning Method of Resin Pellet Store Device]

Next, a cleaning method of the resin pellet store device according to the embodiment of the present invention will be described with reference to FIG. 1.

The cleaning method of the resin pellet store device according to the embodiment of the present invention comprises opening a discharge route for OFF-SPEC products 3; discharging from a silo 1 resin pellets having a high content of foreign substances accumulated in the lowermost part in the silo 1; and then removing foreign substances sticking to the inner wall in the silo 1 while the discharge route for OFF-SPEC products 3 remains open.

In this case, since fine resin powder and small resin fragments sticking to the inner wall of the silo 1 can be removed therefrom and discharged through the discharge route for OFF-SPEC products 3, it is possible to avoid an increase in the content of the foreign substances due to the remaining fine resin powder and small resin fragments which have been sticking to the inner wall of the silo 1 since the last lot was packed.

The above removing step may be accomplished by one or both of an operation of blowing the inside of the silo 1 with carrying air to introduce the resin pellets into the silo 1 and another operation of applying mechanical impact such as hammering or vibration to an outer wall of the silo 1.

In this case, when the existing facility is utilized or a comparatively simple device is added, the inside of the silo 1 can be cleaned.

Next, examples and a comparative example of the present invention will be described.

EXAMPLE 1

A silo 1 (an internal volume: 260 $m^3$, about 180 MT of pellets can be stored) shown in FIG. 1 was used. The silo 1 had a structure including a discharge route for ON-SPEC products 2 (an inner diameter was 12 inches, and a length projecting inwards from a bottom part was 600 mm) constituted of a resin pipe projecting inwards from the bottom part; a discharge route for OFF-SPEC products 3 (an inner diameter of 8 inches) through which resin pellets accumulated in the lowermost part of the silo 1 were extracted; and a sampling route 4 through which the resin pellets were sampled from the center of the silo 1.

Prior to the filling of the resin pellets, the inside of the silo 1 was blown with air, and an outer wall of the silo 1 was hammered to remove fine polycarbonate powder sticking to an inner wall of the silo 1 by static electricity as much as possible. Into this silo 1, 150 MT of polycarbonate resin pellets (containing 80 ppm of the fine polycarbonate powder of 16 meshes and under) were introduced, and about 149.3 MT of the resin pellets were extracted through the discharge route for ON-SPEC products 2. According to measurement, the content of the fine powder of 16 meshes and under in the extracted polycarbonate resin pellets was 30 ppm. A removal ratio of the fine powder of 16 meshes and under was 68%.

This means that, of 12 kg corresponding to 80 ppm of the fine powder contained in 150 MT of the pellets, 7.5 kg stuck to the inner wall of the silo 1. According to measurement, the amount of the fine powder in 700 kg of the resin pellets accumulated in the lowermost part of the silo 1 increased to 220 ppm.

EXAMPLE 2

A cleaning method was carried out in the same manner as in Example 1 except that resin pellets were changed to polycarbonate resin pellets containing 200 ppm of fine powder of 16 mesh pass. As a result, the amount of the fine powder of 16 mesh pass in the polycarbonate resin pellets extracted from the discharge route for ON-SPEC products 2 was 110 ppm. A removal ratio of the fine powder of 16 mesh pass was 45%.

COMPARATIVE EXAMPLE 1

A silo (an internal volume: 260 $m^3$, about 180 MT of pellets can be stored) was used in which a resin discharge pipe (an ON-SPEC discharge route) projecting inwards from a bottom part was not provided. Similarly, prior to the filling of resin pellets, the inside of the silo was blown with air, and an outer wall of the silo was hammered to remove fine polycarbonate powder sticking to an inner wall of the silo by static electricity as much as possible.

Into this silo, 150 MT of polycarbonate resin pellets (containing 80 ppm of fine powder of 16 mesh pass) were introduced. Since the resin discharge pipe (the standardized product discharge route) was not disposed, about 150 MT of the resin pellets were extracted. According to measurement, the content of the fine powder of 16 mesh pass in the polycarbonate resin pellets which was being extracted was similarly 30 ppm. However, in 0.5 ton of the pellets immediately after the start of the extraction and in the pellets after extraction of 147 tons of the pellets, i.e., in the pellets when the silo was almost emptied, the fine powder of 16 mesh pass began to increase. The amounts of the fine powder in 0.5 ton of the first extracted pellets and 1 ton of the lastly extracted pellets rapidly increased to 110 ppm and 180 ppm at maximum, respectively.

In consideration of these examples, when the one silo is regarded as 1 lot, in order to constantly keep the quality of this 1 lot of the resin pellets, at least about 2 to 3 tons of a combination of the pellets immediately after the start of the extraction and the lastly extracted pellets which contain a particularly large amount of the fine powder are judged to be OFF-SPEC products, and they need to be separated from ON-SPEC products.

INDUSTRIAL APPLICABILITY

The present invention can be applied to a resin pellet store device including a silo in which resin pellets are stored, and the present invention is directed to a resin pellet store device suitable for the storage of polycarbonate-based resin pellets, cyclohexane-based resin pellets or the like which requires a low content of foreign substances.

The invention claimed is:

1. A resin pellet store device comprising:

a silo that stores resin pellets;

a discharge route for an ON-SPEC product having a resin pellet inflow port arranged above a lowermost part of the silo and a pipe connecting to the resin pellet inflow port and extending through a bottom part of the silo in a vertical direction through which the resin pellets having a low content of foreign substances are discharged as an ON-SPEC product from the silo; and a second discharge route for an OFF-SPEC product having a resin pellet inflow port arranged at a lowermost part of the silo and a pipe connecting to the resin pellet inflow port and arranged outside of the bottom part of the silo through which the resin pellets having a high content of foreign substances are discharged as an OFF-SPEC product from the lowermost part of the silo.

2. The resin pellet store device according to claim 1, wherein the resin pellet inflow port of the discharge route for an ON-SPEC product has a multiple tube structure, divided into a plurality of portions.

3. The resin pellet store device according to claim 1, further comprising:

a guide member installed in a vicinity of a pellet inlet of the silo that allows the resin pellets charged from the pellet inlet of the silo to fall along an inner wall of the silo, the guide member being an umbrella-like member having a hole in a central portion thereof.

4. The resin pellet store device according to claim 1, further comprising:

a differential pressure adjusting ventilation route which equalizes an internal pressure of the silo with an external pressure of outside air; and a filter installed in the differential pressure adjusting route that prevents the resin pellets stored in the silo from being contaminated with foreign substances from outside air.

5. The resin pellet store device according to claim 1, further comprising:

a gas supply or air supply route through which a gas or air is supplied in order to keep an internal pressure in the silo positive; and a filter installed in the gas supply or air supply route that prevents the resin pellets stored in the silo from being contaminated with foreign substances from outside air.

6. The resin pellet store device according to claim 1, further comprising:

a sampling route through which the resin pellets having a low content of foreign substances stored above the lowermost part in the silo are taken as a sample.

7. The resin pellet store device according to claim 2, wherein the multiple tube structure comprises a plurality of concentric inflow ports.

8. The resin pellet store device according to claim 3, wherein the hole is located beneath the pellet inlet.

9. The resin pellet store device according to claim 1, wherein the discharge route for an ON-SPEC product has a larger diameter than the discharge route for an OFF-SPEC product.

* * * * *